United States Patent [19]

Hollweck

[11] Patent Number: 4,476,453

[45] Date of Patent: Oct. 9, 1984

[54] TEMPERATURE RESPONSIVE SWITCH

[75] Inventor: Walter Hollweck, Nuremberg, Fed. Rep. of Germany

[73] Assignee: Thermostat- und Schaltgerätebau GmbH & Co., Bad Kissingen, Fed. Rep. of Germany

[21] Appl. No.: 465,637

[22] Filed: Feb. 10, 1983

[30] Foreign Application Priority Data

Feb. 10, 1982 [DE] Fed. Rep. of Germany ..... 3204638

[51] Int. Cl.[3] ..... H01H 37/26

[52] U.S. Cl. ..... 337/361; 337/347; 337/368

[58] Field of Search ..... 337/361, 360, 353, 349, 337/347, 368, 374, 375, 349, 350, 351

[56] References Cited

U.S. PATENT DOCUMENTS

| | | | |
|---|---|---|---|
| 3,569,893 | 3/1971 | Pembrook | 337/347 |
| 3,878,498 | 4/1975 | Allen et al. | 337/347 |
| 4,345,389 | 8/1982 | Balchunas et al. | 337/361 |

*Primary Examiner*—Harold Broome

*Attorney, Agent, or Firm*—Spencer & Frank

[57] ABSTRACT

A temperature responsive switch has a bimetal-and-spring arrangement carrying a movable contact and having a first stable state urging the movable contact towards a stationary contact into an ON position and a second stable state urging the contacts away from one another into an OFF position; and a setting shaft setting the bimetal-and-spring arrangement to a desired temperature value at which the bimetal-and-spring arrangement displaces the movable contact from the ON position into the OFF position. The setting shaft has a relatively low temperature setting range and a relatively high temperature setting range. The switch further has a stopping mechanism having an operative and an inoperative state for preventing the bimetal-and-spring arrangement from assuming the second stable state in the operative state of the stopping mechanism and for allowing the bimetal-and-spring arrangement to assume the second stable state in the inoperative state of the stopping mechanism. The setting shaft places the stopping mechanism in its operative state in the low temperature setting range and places the stopping mechanism in its inoperative state in the high temperature setting range.

13 Claims, 10 Drawing Figures

TEMPERATURE RESPONSIVE SWITCH

BACKGROUND OF THE INVENTION

This invention relates to a temperature responsive switch having a stationary contact, a movable contact cooperating with the stationary contact and carried on a bistable (over-the-center) spring which, in turn, is mounted on a setting arm. The switch further includes a bimetal member which, upon heating, can displace the bistable spring so that the movable contact lifts off the stationary contact to place the switch from an ON position to an OFF position. By virtue of the force exerted by the heated bimetal on the bistable spring, the latter may snap over-the-center from a first stable position (in which the bistable spring urges the movable contact into engagement with the stationary contact) into a second stable position (in which the bistable spring urges the movable contact away from the stationary contact). Further, the switch has a setting shaft which, for example, by manual actuation, adjusts the setting arm between an OFF position and a maximum temperature position for determining the temperature value at which the bimetal effects separation of the movable contact from the stationary contact. The temperature responsive switch further includes a plunger which, when held in a spring-stopping position, blocks the motion of the bistable spring at a location between the ON ("contacts closed") position and the dead center for preventing the bistable spring from reaching its dead center and thus snapping from its first stable state into its second stable state.

A switch of the above-outlined known type is a temperature limiting switch used, for example, for controlling cooking plates in cooking ranges or water heaters. A temperature selection is effected by means of an appropriate angular setting of the setting shaft. As a function of such angular setting, the position of the setting arm is varied. Since the setting arm carries the movable contact spring which is designed as an over-the-center bistable spring, a temperature may be set at which the bimetal causes the bistable spring to snap from its first stable state into its second stable state in which the spring maintains the contacts in an open (OFF) position, after having travelled through its dead center. It is not feasible to bring the bistable spring thereafter into a "contacts closed" (ON) position merely by rotating the setting shaft. Thus, by rotating the setting shaft it is not feasible to resume a heating process which was interrupted due to the temperature limiting operation of the switch. Rather, a resumption of the heating process is preconditioned on resetting the bistable spring by means of a separate plunger over its dead center into its original initial position with respect to the setting arm. Such temperature limiting switches have a relatively complex structure, they are not convenient to operate and are furthermore limited in their function.

Further, temperature regulating switches are known which permit heating, for example, of a water heater, to a preselected temperature and then maintain the heated water at that temperature. The structure of such switches is similar to that outlined earlier for temperature limiting switches. In such temperature regulating switches, however, the contact spring is prevented from snapping—urged by the bimetal—over its dead center into the final open position relative to the setting arm. If in such temperature limiting switches the desired temperature is reached, the bimetal moves the contact spring into its OFF position. By virture of the cooling of the bimetal, effected by shutting off the heat, the contact spring, by virtue of its bias, swings back into the ON position whereupon heating proceeds up to the successive switch-off period. The functioning of temperature regulating switches of this type is limited to the heating to a certain temperature and to maintain the temperature at that value.

It is further known to equip a water heater both with a temperature regulating switch and a temperature limiting switch. Such a combination makes possible the following advantageous mode of operation: the temperature regulating switch is effective in a heating range, for example, between 0° and maximum 80° C. In this temperature range the temperature may be maintained on a desired level throughout the entire period in which the heating apparatus is operative, for example, to heat and keep warm nursing bottles or baby food. If the temperature is maintained by a temperature regulating switch above the noted temperature range, there are risks that the water vaporizes. Therefore, in this range, the above-outlined temperature limiting switch is effective which, when the preset temperature level is reached, permanently opens the heating circuit. In everyday use, however, the moment of automatic OFF switching does not always coincide with the time when the heated article, such as water should be available for use at the desired set temperature. If there lapses an appreciable period between the automatic switch-off of the temperature limiting switch and the time when the heated water is to be utilized, the water has to be again heated for a short time to the desired temperature. For this purpose, a resetting plunger has to be depressed. A new energization by depressing the plunger, however, is possible only when the bimetal has already reached a predetermined cooled state. Before such state is reached, the insufficiently cooled bimetal prevents a return of the bistable contact spring over its dead center into its ON position relative to the setting arm.

SUMMARY OF THE INVENTION

It is an object of the invention to provide a temperature responsive switch of the above-outlined type which, by virture of an appropriate rotation of the setting shaft, operates in a lower temperature range of, for example, 0° to 80° C. as a temperature regulator and in an upper temperature range of, for example, 80° to 100° C., operates as a temperature limiting switch.

This object and others to become apparent as the specification progresses, are accomplished by the invention, according to which, briefly stated, the temperature responsive switch comprises a holding spring which maintains the contact spring stopping plunger in its stopping position and a cam affixed to the setting shaft and cooperating with the holding spring to effectively disconnect the holding spring from the stopping plunger (and thus release the same) in an angular position of the setting shaft which corresponds to a high temperature setting range.

The principle of the solution according to the invention is based on the fact that in an angular position of the setting shaft corresponding to the lower temperature range, the stopping plunger is continuously held in its spring stopping position in which it limits the displacement of the bistable spring to the swinging range prior to passing the dead center, whereas in an angular position of the setting shaft which corresponds to the upper temperature range, the stopping plunger may be shifted back freely by the contact spring as the latter is moved outwardly by the bimetal. Thus, under these conditions the stopping plunger is inoperative and the bistable spring is allowed to snap from its first stable state (in which it urges the contacts into an ON position) into its second stable state (in which it urges the contacts into an OFF position). The opening pressure of the bimetal or, as the case may be, the bistable spring is amply sufficient to push back the stopping plunger from its operative, spring stopping position into an inoperative position. Once the switch, while the setting shaft is in an angular position which corresponds to the higher temperature range, has performed its function as a temperature limiting switch and thereafter the bimetal has cooled to a temperature lying in the lower temperature range, the setting shaft only has to be briefly turned once into the lower temperature range in which the holding spring is again activated and thus the plunger is advanced into its operative, spring stopping position. In this manner there is effected the earlier-noted reclosing of the switch. Thereafter, the setting shaft needs only to be brought again into an angular position which corresponds to the desired final temperature in the higher temperature range. Upon a short reheating period the switch, when the desired temperature is reached, opens the contacts and thus functions as a temperature limiting switch.

According to a further feature of the invention, the holding spring is in engagement with the free end of the stopping plunger and the engaging part of the holding spring may be displaced from the stopping plunger by the cam. Further, the stopping plunger is oriented approximately parallel to the setting shaft and the holding spring is a leaf spring, whose working (plunger-engaging) end is situated in the intermediate space between the stopping plunger and the setting shaft. These features characterize a particularly simple structure of the switch and make possible a simple mode of operation thereof.

According to a further feature of the invention, the setting shaft has, between its two angular end positions, an intermediate angular position which sets the cam into an angular position in which it activates the holding spring. Thus, while the switch structure according to the broadest scope of the invention permits a reclosing of the switch subsequent to a temperature-caused opening of the contacts only when the bimetal has cooled to a temperature level in the lower temperature range, according to the last-named features, upon a temperature-caused opening, the heating apparatus served by the switch may be energized after a desired short period so that, for example, water may be immediately reheated to the earlier-set desired temperature. This possibility is based on the fact that the deactivation of the holding spring and thus the stopping plunger is cancelled not by returning the setting shaft in the direction of the OFF position, but by further rotating the shaft in the direction of a still higher temperature. By further rotating the setting shaft (which is expediently designed as a threaded bar and supported in the switch frame) in the direction of a still higher temperature range, the setting arm supporting the bistable spring is not returned into a lower temperature setting so that the bimetal which has not yet cooled to the lower temperature range, cannot prevent the bistable spring from moving through its dead center back into the ON position.

According to still another feature of the invention, a torque-exerting spring is provided which is so arranged that when the cam is in a position between the holding spring activating position and the position corresponding to the highest temperature setting, it rotates the setting shaft back into the holding spring activating position of the cam. This feature automatically prevents a re-energization of the heater which could lead to overheating. Thus, immediately upon manual release of the setting shaft, for example, after it was manually turned to the abutment for the highest temperature, the torque-exerting spring returns the setting shaft into the angular position in which the holding spring and thus the stopping plunger are deactivated to again permit the switch to perform its function as a temperature limiting switch. In this manner the risks of overheating by means of a permanent angular position of the setting shaft corresponding to a temperature above the higher temperature zone is eliminated in which the temperature responsive switch would—if allowed—again perform as a temperature regulating switch (in the manner it operates in the lower temperature range).

According to a further feature of the invention, the cam is part of a bent-out portion of a disc such as a spring disc affixed to the setting shaft. Further, the disc has at least one radial projection serving as an abutment to stop rotation. One of the radial projections serves as a support for one end of the torque-exerting spring. These features provide that the cam may be obtained by a simple modification of an abutment disc which is in any event present in earlier-described known temperature responsive switches. Thus, the disc needs only to be bent out in the axial direction at a predetermined location to form a cam.

According to further features of the invention, a radial projection is the disc serves as a support for one end of the torque-exerting spring. Further, the counter abutment for the rotation-stopping abutment of the radial projection is formed by the plunger support, particularly by a support sleeve for the stopping plunger. Also, expediently, the stopping plunger support forms a seat for another end of the torque-exerting spring. One spring end is looped around the support sleeve for the stopping plunger. For a positioning of the torque-exerting spring these features may be provided in components which are in any event present in conventional temperature responsive switches.

DESCRIPTION OF THE PREFERRED EMBODIMENTS

Figure 1:
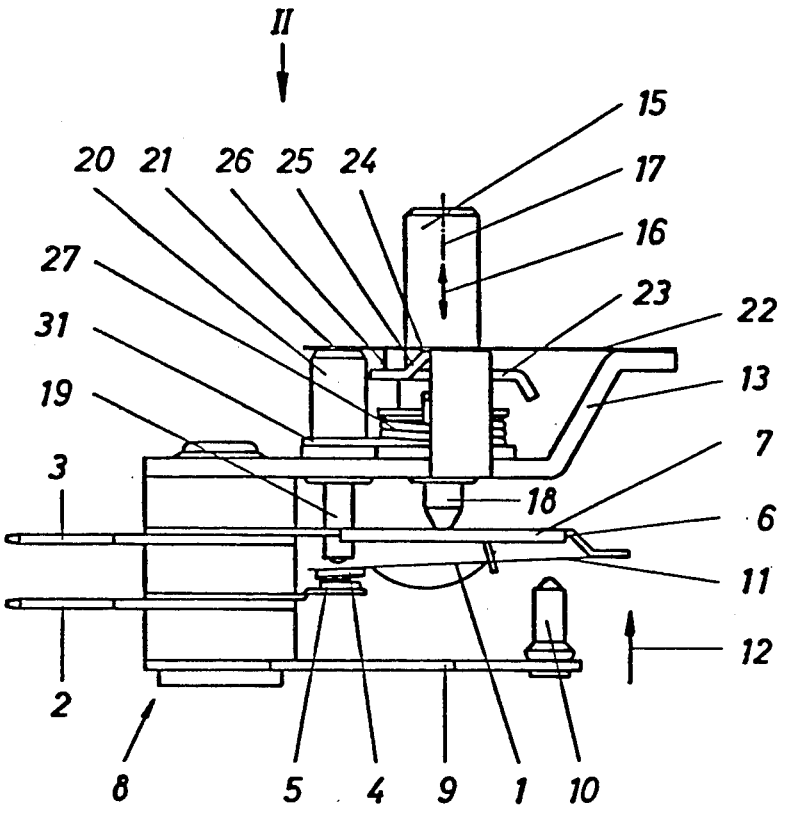
FIG. 1 is a side elevational view of a temperature responsive switch according to a preferred embodiment of the invention, showing the switch in a setting for functioning as a temperature regulator.
Figure 2:
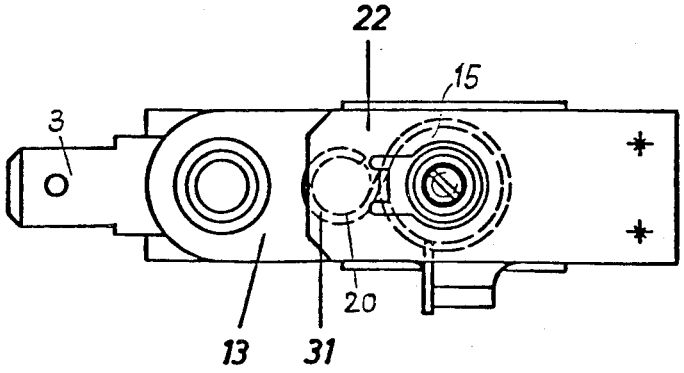
FIG. 2 is a top plan view of the structure illustrated in FIG. 1 (as viewed in the direction of the arrow II).

Turning now to FIGS. 1 and 2, the temperature responsive switch shown therein comprises a bistable contact spring 1 illustrated in the closed position (ON position) in which a movable contact 4 mounted at a free end of the bistable spring 1 and a stationary contact 5 are in engagement to electrically connect switch terminals 2 and 3 to thus close an electric circuit. The end 11 of the bistable spring 1 is secured to a movable end 6 of a setting arm 7 which is displaceable parallel to the direction of the bistable spring 1, that is, parallel to the plane of FIG. 1. A bimetal 9 is secured to a switch frame generally designated at 8 and cooperates, by means of a projection 10 made of an insulating material, with the end 11 of the bistable spring 1 adjacent the location where it is fastened to the setting arm 7. As the environment of the switch heats up, the bimetal 9 moves in the direction of the arrow 12 upwardly and, with the projection 10, engages the end 11 of the bistable spring 1. On a cantilevered component 13 forming part of the switch frame 8 there is threadedly supported a setting shaft 15, which, upon rotation, executes an axial displacement parallel to the arrow 16 between a maximum withdrawn position (OFF position) and a maximum advanced position (corresponding to a maximum temperature setting). The longitudinal axis 17 of the setting shaft 15 is approximately parallel to the direction of motion of the bimetal 9 and the bistable spring 1. The setting shaft 15 engages with its insulated front end 18 the setting arm 7 at its side oriented away from the bimetal 9 and, by virtue of the axial component of its rotary motion between the two end positions, causes the setting arm 7 to be displaced (bent) accordingly.

The temperature responsive switch further comprises a plunger (stopping plunger) 19 which is slidably supported in a sleeve 20 affixed to the cantilevered member 13, for displacement in a direction parallel to the axis 17 of the setting shaft 15. In its lowest position shown in FIG. 1, the leading end of the plunger 19 forms an abutment adapted to stop the bistable spring 1 before the latter reaches its dead center during displacement in the direction of the arrow 12, as will be described in greater detail below.

The reverse (upper) end or head 21 of the plunger 19 is engageable by a leaf spring (holding spring) 22 which is biased in such a manner that it seeks to maintain the plunger 19 in its stopping position (depicted in FIG. 1) in which the plunger 19 permits an opening motion of the bistable spring 1 in the direction of the arrow 12, but the motion is limited such that the bistable spring 1 does not reach its dead end center and thus cannot snap from its first stable state (in which it urges the contact 4 into engagement with the contact 5) into its second stable state (in which it urges the contact 4 away from the contact 5). It is noted that in the second stable state the switch contacts 4, 5 are in a permanently open position. When the spring 1 is allowed to assume its second stable state, the switch functions as a temperature limiting switch.

To the setting shaft 15 there is affixed a disc or a spring ring 23 which, along a certain angular range of approximately 10° to 20° which corresponds to a desired temperature range in which the switch operates as a temperature limiting switch, is provided with a bent portion constituting a cam 24. The latter projects in the axial direction 16 towards the holding spring 22 and, at both sides of its elevated work face, has sloping faces 25 which constitute a transition between the cam 24 and the disc 23. The holding spring 22 has a part 26 which cooperates with the cam 24 and which is situated in a space between the plunger 19 and the setting shaft 15 above the disc 23.

Figure 5:
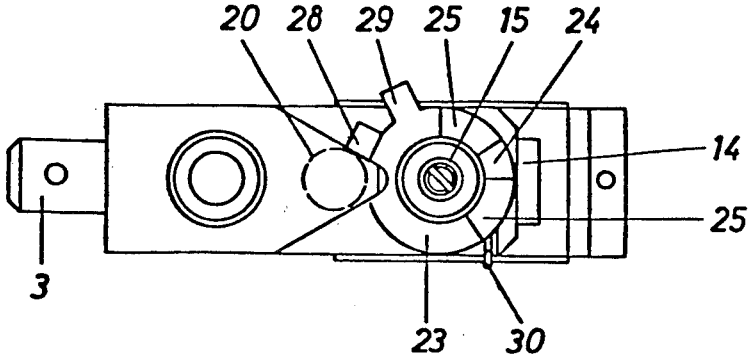
FIGS. 5, 6, 7 and 8 are top plan views of the structure shown in FIGS. 3 and 4 (as seen in the direction of the arrow V in FIGS. 3 and 4) showing different angular positions of a switch component.
Figure 6:
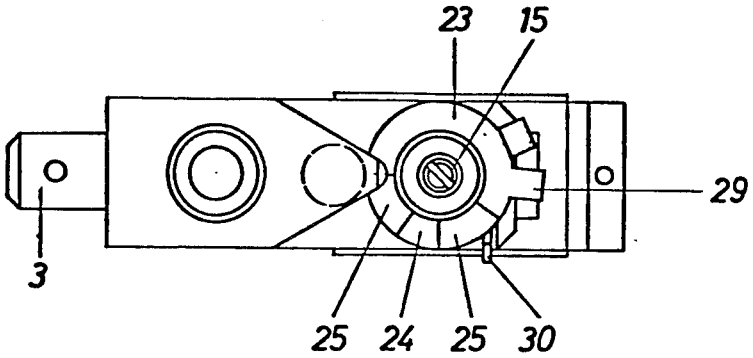
Figure 7:
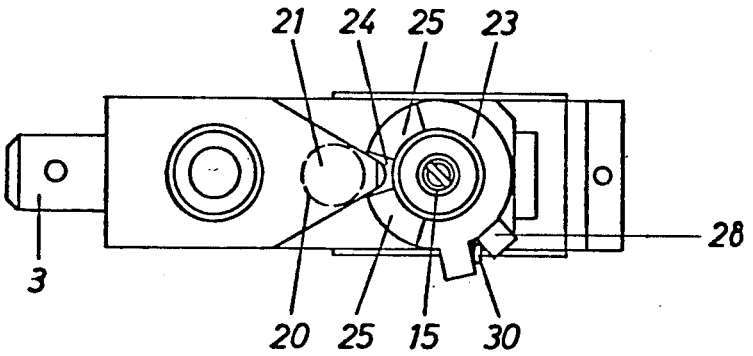
Figure 8:
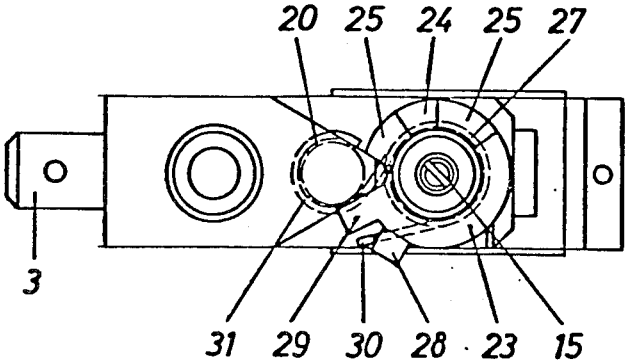

A coil spring or spiral spring (torque-exerting spring) 27 surrounds the setting shaft 15 and exerts such a torque bias thereon that in the position of the cam 24 as shown in FIG. 8, it returns the setting shaft 15 into the angular position shown in FIG. 7 in which the cam 24 operatively engages the portion 26 of the holding spring 22. The torque-exerting spring 27 has no effect in the angular positions of the setting shaft 15 shown in FIGS. 5, 6 and 7. The torque-exerting spring 27 by surrounding the setting shaft 15 with its turns, is thus guided by the setting shaft 15. The disc 23 is, as shown in FIGS. 5–8, provided with radial projections 28 and 29 which are effective as stops for limiting the range of shaft rotation and are, for this purpose, as shown in FIGS. 5 and 8, in engagement with the support sleeve 20 of the plunger 19 in the two extreme angular positions (limit positions) of the setting shaft 15.

The radial projection 28 of the disc 23 forms a counter support for that end 30 of the torque-exerting spring 27 which is adjacent the setting shaft 15. The counter stop for the rotary abutments constituted by the radial projections 28 and 29 is formed by the support sleeve 20 of the plunger 19, as shown in FIGS. 5 and 8. The support sleeve 20 further constitutes a counter support for that end 31 of the torque-exerting spring 27 which is adjacent the plunger 19. The spring end 31 forms a loop which, as seen in FIGS. 2 and 8, is inserted on the support sleeve 20.

Figure 3:
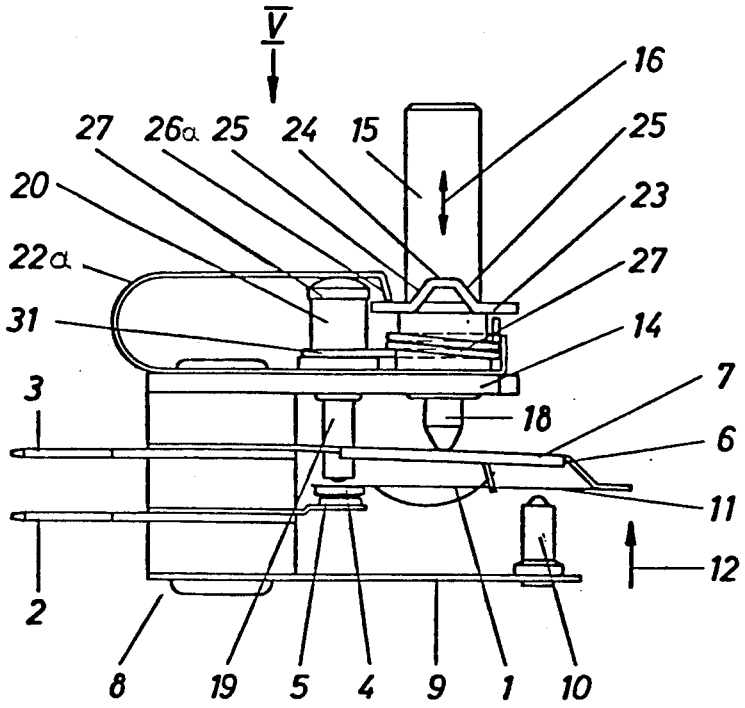
FIG. 3 is a side elevational view of a temperature responsive switch according to another preferred embodiment of the invention, showing the switch in a setting for functioning as a temperature regulator.
Figure 4:
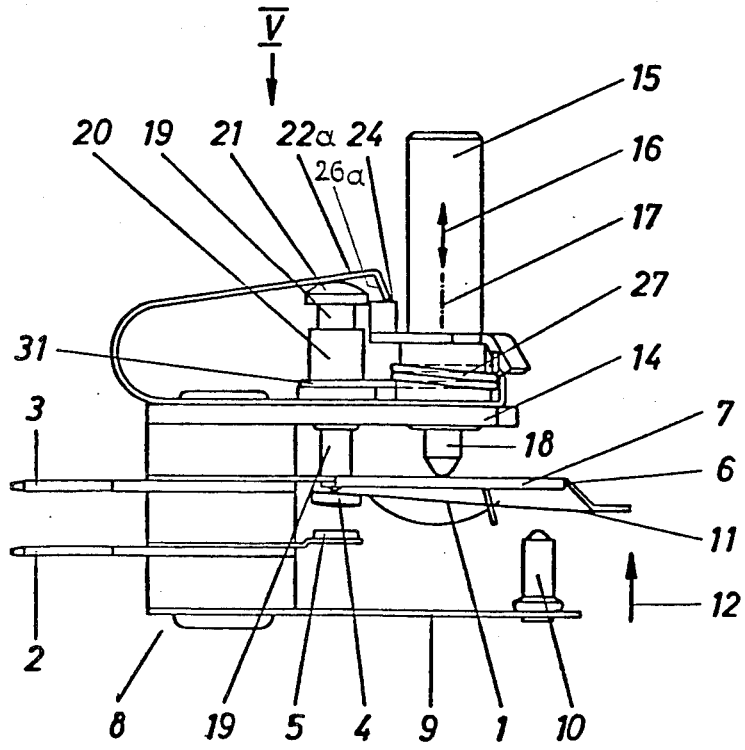
FIG. 4 is a side elevational view of the embodiment shown in FIG. 3, showing the switch in a setting for functioning as a temperature limiting switch.

Turning now to FIGS. 3 and 4, the embodiment shown therein essentially corresponds to that shown in FIG. 1, but for the design of the holding spring. Thus, while in the FIG. 1 embodiment the holding spring 22 lies in a single plane and is affixed to an elevated end of the cantilevered member 13, in the embodiment according to FIGS. 3 and 4 the holding spring 22*a* is a generally C-shaped leaf spring affixed at one end to a generally planar cantilevered member 14. FIG. 3 shows the holding spring 22*a* in its working position in which it maintains the stopping plunger 19 in its advanced position for constituting a stop for the bistable spring 1 before it reaches its dead center during a contact-opening displacement. FIG. 4 shows the holding spring 22*a* in its inoperative position into which it has been lifted by virtue of the spring part 26*a* riding up the cam 24. Further, FIG. 4 shows the bistable spring 1 in its second stable position in which the spring 1 urges the contact 4 away from the contact 5. It is seen that due to the fact that the holding spring 22*a* is in its inoperative position, the bistable spring 1, urged by the bimetal 9, could readily push the stopping plunger 19 from its advanced position into a withdrawn position.

The mode of operation of the temperature responsive switch according to the invention will be described with reference to FIGS. 3 to 10. FIG. 10 illustrates the markings on a rotary operating knob 32 affixed to the setting shaft 15.

Figure 9:
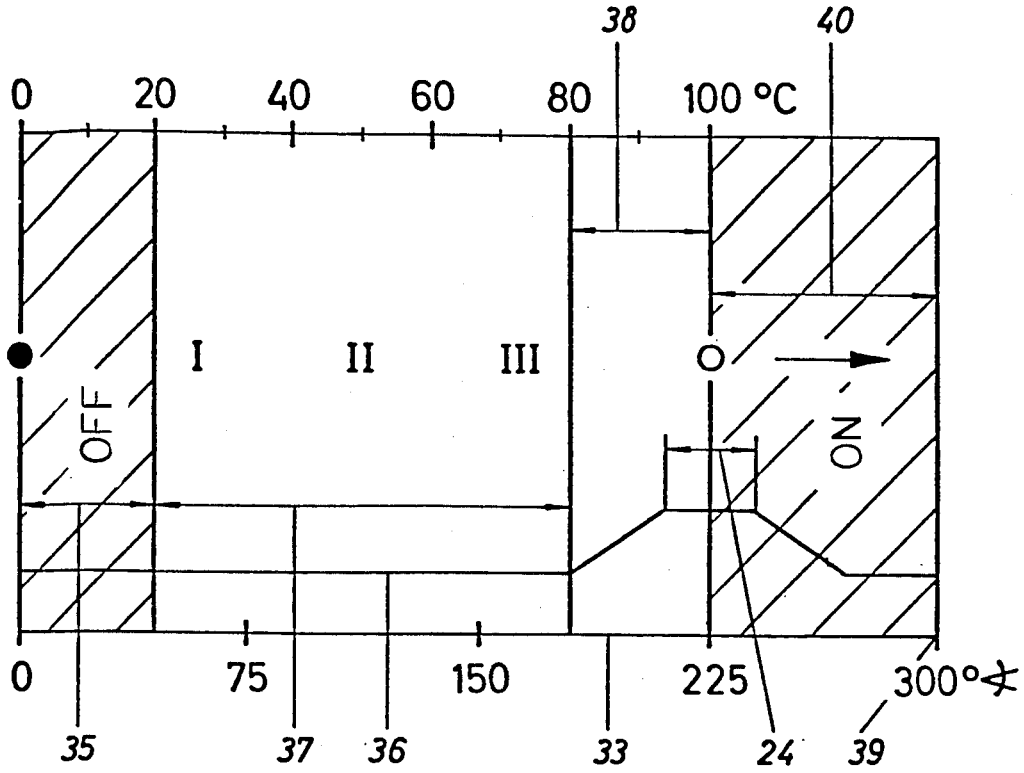
FIG. 9 is an operational diagram of the temperature responsive switch according to the invention.
Figure 10:
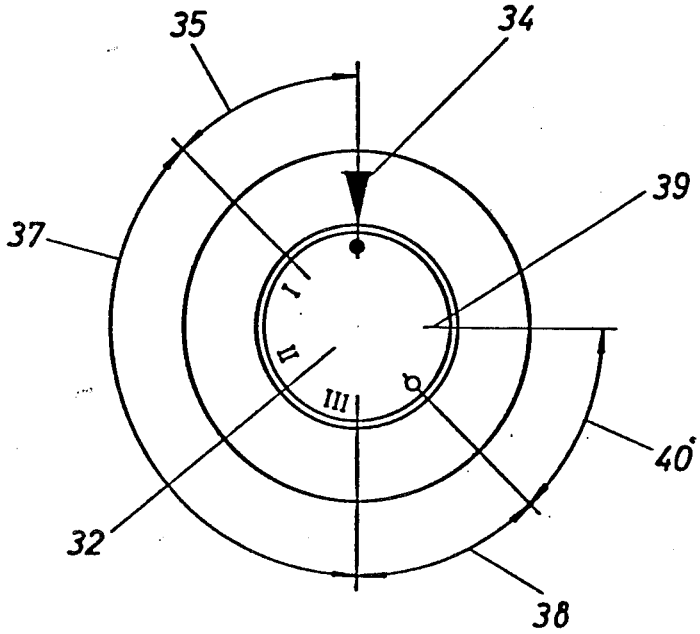
FIG. 10 is a plan view of an operating knob forming part of the temperature responsive switch according to the invention and bearing temperature setting symbols.

In the diagram of FIG. 9, the abscissa 33 indicates the angular settings of the rotary knob 32, wherein the starting position(0° angle) is the OFF position shown in FIG. 5. This position of the knob 32 is depicted in FIG. 10, where the solid-dot marking on the knob face is aligned with the indicator arrow 34 provided on the switch housing. Above the abscissa 33 there is shown a development 36 of the effective surface of the disc 23 which includes the cam 24.

In the OFF position (FIG. 5) the leading end 18 of the setting shaft 15 is advanced to such an extent and consequently, the setting arm 7 is bent such that the movable contact 4 is at a distance above the stationary contact 5 and may engage the leading end of the plunger 19 maintained in its stopping position by the holding spring 22*a*.

As the knob 32 and thus the setting shaft 15 is rotated clockwise as viewed in FIG. 10, the leading end 18 of the setting shaft 15 is gradually withdrawn. Thus, the extent of bending deformation of the setting arm 7 is reduced until the contacts 4 and 5 arrive into engagement with one another. With this occurrence, as indicated on the operating knob 32, the ON position I is reached which is the beginning point of the temperature regulating range 37 of the switch. The farther the operating knob 32 is rotated (FIG. 6) the more the leading end 18 of the setting shaft 15 is withdrawn and accordingly the setting arm 7 pivots backward in the direction of the arrow 12. Also, the more the leading end 18 of the setting shaft 15 is withdrawn and thus the farther the setting arm 7 pivots in the direction of the arrow 12, the greater the path through which the bimetal 9 has to swing in order to arrive, with its projection 10, into contact with the bimetal spring 1 and to push the latter into an OFF (circuit opening) position. Thus, the farther the operating knob 32 is rotated (up to an angle of approximately 160° ) the higher the temperature at which the bimetal 9 displaces the bistable spring 1 to thus lift the movable contact 4 off the stationary contact 5. During this occurrence the bistable spring 1 can be lifted only to such an extent until it abuts the leading end of the stopping plunger 19 which is still maintained by the holding spring 22*a* in the stopping position.

If now the knob 32 is rotated clockwise beyond the marking III, the switch is in its temperature limiting function range 38. In this range the cam 24 lifts the holding spring 22*a* off the head 21 of the plunger 19. Further, the leading end 18 of the setting shaft 15 has been retracted even more, so that the setting arm 7, by virtue of its inherent bias, is swung away even farther from the bimetal 9. Thus, the bimetal has to execute an even further swinging motion before it can cause the bistable spring 1 to move the contact 4 into an OFF position. Consequently, the temperature limiting range 38 is at a higher temperature level than the temperature regulating range 37. If now the bimetal 9, by virtue of a substantial heating, is deformed to such an extent that it lifts off the bistable spring 1 from its contacting position, the bistable spring 1 is pushed beyond its dead center position because the stopping plunger 19 is no longer immobilized by the holding spring 22*a* to prevent such an occurrence. The pressure exerted by the bimetal 9 on the bistable spring 1 is sufficient to lift the plunger 19 from its advanced, stopping position shown in FIGS. 1 and 3 into its withdrawn position shown in FIGS. 4 and 7. Up to this last-named rotary position of the setting shaft 15, the torque-exerting spring 27 has remained ineffective because its end 30 adjacent the setting shaft 15 has not yet arrived into contact with the radial projection 29 of the disc 23.

In order to return the switch to an ON position even immediately after an OFF switching has occurred in the temperature limiting range 38, the knob is rotated further in the clockwise direction until its terminal abutment 39 registers with the indicator arrow 34. During such a rotation, the switch is in the operational range 40 shown in FIGS. 9 and 10. At the end of this rotation the setting shaft 15 assumes its angular position in accordance with FIG. 8. The cam 24 has moved away from under the holding spring 22*a* which is thus again rendered effective. As a result, the holding spring 22*a* presses the plunger 19 into its advanced, stopping position. At the same time, the plunger 19 swings the bistable spring 1 back over its dead center which may occur independently from the temperature level of the already cooling bimetal 9, because by having rotated the setting shaft 15 further in a clockwise direction, its leading end 18 is retracted even more away from the bimetal 9. Until reaching the terminal abutment 39, the radial projection 29 carries with it the end 30 of the torque-exerting spring 27 whereby the latter is armed. As the terminal abutment 39 is reached, the knob 32 is released from manual engagement. As a result, the torque-exerting spring 27 returns the setting shaft 15 from the position shown in FIG. 8 into the position shown in FIG. 7 in which the cam 24 again lifts the holding spring 22*a* from its operative position in which it immobilizes the stopping plunger 19. The ON switching, that is, the renewed engagement between the contacts 4 and 5 effected by the rotation of the knob 32 into its terminal position 39 is thus only momentary. Since the renewed heating of the device causes the bimetal 9 to effect an opening of the contacts 4 and 5, the shutoff is automatic. This is so, because by virtue of the return rotation of the setting shaft 15 effected by the torque-exerting spring 27 after the operating knob 32 is manually released, the switch is automatically returned into the temperature limiting range 38.

It will be understood that the above description of the present invention is susceptible to various modifications, changes and adaptations, and the same are intended to be comprehended within the meaning and range of equivalents of the appended claims.

What is claimed is:

1. A temperature responsive switch comprising (a) a bimetal arranged for displacement in response to temperature changes;

(b) a displaceably arranged setting arm;

(c) a stationary first contact;

(d) a bistable, over-the-center spring mounted on said setting arm and carrying a second contact cooperating with said first contact; said bistable spring having a first state in which said bistable spring urges said second contact towards engagement with said first contact and a second state in which said bistable spring urges said second contact away from said first contact; said bimetal being operatively connected with said bistable spring for moving said bistable spring from said first state towards and into said second state beyond a dead center position thereof;

(e) a setting shaft operatively connected with said setting arm and being rotatably and axially displaceably supported for displacing said setting arm and said bistable spring between first and second angular limit positions of said setting shaft; in said first limit position of said setting shaft said contacts are separated from one another and in said second limit position of said setting shaft the highest temperature value is set at which said first and second contacts separate in response to the displacement of said bimetal;

(f) a movable stopping plunger cooperating with said bistable spring and having an operative position in which said bistable spring enters into an abutting relationship with said stopping plunger prior to reaching said dead center during a displacement of said bistable spring in said first state towards said second state;

(g) a holding spring cooperating with said stopping plunger and arranged for assuming first and second positions; in said first position of said holding spring said holding spring maintains said stoping plunger in the operative position thereof, whereby said bistable spring is prevented by said stopping plunger from assuming said second state; in said second position of said holding spring said stopping plunger allows said bistable spring to assume said second state; and (h) a cam affixed to said setting shaft for rotation therewith; said cam being operatively connected with said holding spring for setting said holding spring in said first or second position thereof dependent upon an angular position of said setting shaft; said cam moving said holding spring into and maintaining said holding spring in the second position thereof when said setting shaft is in an angular position corresponding to a temperature setting in a high temperature range.

2. A temperature responsive switch as defined in claim 1, wherein said stopping plunger has a first end cooperating with said bistable spring and an opposite second end cooperating with a portion of said holding spring; in said first position of said holding spring said portion thereof is maintained in engagement with said second end of said stopping plunger in the operative position thereof, and in said second position of said holding spring said portion thereof is spaced from said second end of said stopping plunger when said stopping plunger is in said operative position.

3. A temperature responsive switch as defined in claim 2, wherein said stopping plunger is oriented substantially parallel to said setting shaft and further wherein said holding spring is a leaf spring and said portion thereof is situated between said stopping plunger and said setting shaft.

4. A temperature responsive switch as defined in claim 1, further comprising a disc affixed to said setting shaft; said cam being formed by a bent-out part of said disc.

5. A temperature responsive switch as defined in claim 4, wherein said disc has at least one radial projection forming an abutment for limiting the angular displacement of said setting shaft.

6. A temperature responsive switch as defined in claim 1, wherein said cam is arranged on said setting shaft such that said cam moves said holding spring into said second position thereof at an intermediate angular position of said setting shaft between said first and second limit positions thereof.

7. A temperature responsive switch as defined in claim 6, further comprising a torque-exerting spring operatively connected to said setting shaft for imparting a torque to said setting shaft when said setting shaft is in an angular position between said intermediate angular position and said second limit position.

8. A temperature responsive switch as defined in claim 7, wherein said torque-exerting spring is a coil spring surrounding said setting shaft and having first and second ends.

9. A temperature responsive switch as defined in claim 8, further comprising a disc affixed to said setting shaft; said disc having a bent-out part forming said cam and a radial projection forming a support for said first end of said coil spring.

10. A temperature responsive switch as defined in claim 9, further comprising a support sleeve receiving said stopping plunger; said radial projection being arranged for abutting said sleeve at a predetermined angular position of said setting shaft for limiting an angular displacement thereof.

11. A temperature responsive switch as defined in claim 10, wherein said support sleeve forms a support for said second end of said torque-exerting spring.

12. A temperature responsive switch as defined in claim 11, wherein said second end of said coil spring is closely looped around said support sleeve.

13. A temperature responsive switch comprising (a) cooperating stationary and movable contacts having an engaged or ON position and a separated or OFF position;

(b) bimetal-and-spring means carrying said movable contact and being arranged for displacement in response to temperature changes; said bimetal-and-spring means having a first stable state urging said contacts towards said ON position and a second stable state urging said contacts into an OFF position;

(c) a setting shaft operatively connected to said bimetal-and-spring means for setting said bimetal-and-spring means to a desired temperature value at which said bimetal-and-spring means displaces said movable contact from said ON position into said OFF position; said setting shaft having first positions corresponding to a relatively low temperature range and second positions corresponding to a relatively high temperature range;

(d) stopping means having an operative and an inoperative state for preventing said bimetal-and-spring means from assuming said second stable state in said operative state of said stopping means and for allowing said bimetal-and-spring means to assume said second stable state in said inoperative state of said stopping means; and (e) holding means operatively connected to said setting shaft and said stopping means for maintaining said stopping means in said operative state when said setting shaft is in any of said second positions and for maintaining said holding means in said inoperative state when said setting shaft is in any of said first positions.

* * * * *